United States Patent [19]

Bacskay

[11] 4,218,103

[45] Aug. 19, 1980

[54] HAMPER

[76] Inventor: Stephen A. Bacskay, 247 Glenwild Ave., Bloomingdale, N.J. 07506

[21] Appl. No.: 943,957

[22] Filed: Sep. 20, 1978

[51] Int. Cl.[2] ..... A47B 81/00; B65D 91/00

[52] U.S. Cl. ..... 312/211; 312/45; 312/72; 232/43.1

[58] Field of Search ..... 312/211, 45, 72; 232/43.1, 43.2

[56] References Cited

U.S. PATENT DOCUMENTS

| | | | |
|---|---|---|---|
| 27,406 | 7/1897 | Gilfillan | 312/45 |
| 2,319,384 | 5/1943 | Callan et al. | 232/43.2 |
| 2,593,836 | 4/1952 | Bock | 232/43.2 |
| 2,769,516 | 11/1956 | Hensley, Jr. | 232/43.1 |
| 2,888,307 | 5/1959 | Graves et al. | 312/211 |
| 3,099,390 | 7/1963 | Dylla | 232/43.2 |
| 3,151,920 | 10/1964 | Burrell | 312/35 |
| 3,162,361 | 12/1964 | Brighton et al. | 232/43.2 |
| 3,316,040 | 4/1967 | McGann | 312/45 |
| 3,322,477 | 5/1967 | Armijo | 232/43.2 |
| 3,904,218 | 9/1975 | Kostic | 232/43.2 |

FOREIGN PATENT DOCUMENTS

| | | | |
|---|---|---|---|
| 120464 | 10/1970 | Norway | 232/43.2 |
| 1519066 | 7/1978 | United Kingdom | 312/72 |

*Primary Examiner*—Victor N. Sakran

*Attorney, Agent, or Firm*—Samuelson & Jacob

[57] ABSTRACT

A hamper for collecting items, such as soiled laundry, includes a cylindrical receptacle wall having a reception entrance at the top and a delivery port at the side, the delivery port being selectively opened or closed by a cylindrical sleeve which overlies the receptacle wall and can be rotated relative thereto, and a liner within the receptacle for receiving the items placed therein through the reception entrance and for being withdrawn through the delivery port, when the sleeve is rotated to open the delivery port.

17 Claims, 5 Drawing Figures

HAMPER

The present invention relates generally to hampers and pertains, more specifically, to a hamper in which the items to be collected in the hamper are placed in a liner therein through a reception entrance and are removed, while in the liner, through a separate delivery port.

A wide variety of hampers is available currently for general as well as for specific uses. In the gathering of items, such as soiled laundry, hampers serve the purpose of providing a convenient collection device. However, once the items are collected, it is desirable that the delivery of the items from the hamper also be accomplished with ease. Thus, many hampers have been provided with reception entrances and separate delivery ports, each being designed, respectively, for the specific function of receiving gathered items, item-by-item, and subsequently for delivering a completed collection of items, in a single load. In particular, portable hampers of the type described find use in hotels, motels, hospitals and other institutions where items, such as soiled linens, towels and the like, are gathered frequently, on a regular basis, from a plurality of locations and delivered, in one load, to a specific point for processing.

An object of the present invention is to provide a hamper which is easy to load and unload and enables simplified handling of gathering items, such as soiled laundry.

Another object of the invention is to provide a hamper of the type described in which items to be gathered are received through a reception entrance especially designed to facilitate reception of the gathered items and are delivered through a delivery port especially designed to ease unloading of the hamper.

Still another object of the invention is to provide a hamper of the type described which is simple in construction and use and can be economically manufactured of readily available, inexpensive materials.

Yet another object of the invention is to provide a hamper of the type described and which is portable for ready movement among collection points, and between collection points and a delivery point.

A further object of the invention is to provide a hamper which not only functions well, but which is aesthetically pleasing in appearance.

A still further object of the invention is to provide a hamper having sufficient flexibility of operation to find use in a wide variety of applications.

The above objects, as well as still further objects and advantages, are attained by the present invention which may be described briefly as a hamper for collecting items placed therein, the hamper comprising: a receptable having a generally cylindrical tubular wall extending axially between opposite ends, the receptacle including a reception entrance at one of the ends and a delivery port located in the wall between the ends, the reception entrance and the delivery port both communicating with the interior of the receptacle; a cylindrical sleeve juxtaposed with the tubular wall of the receptacle and mounted upon the receptacle for rotation relative to the tubular wall between a first position, wherein the sleeve closes the delivery port, and a second position, the cylindrical sleeve including an aperture so located therein that the aperture is registered with the delivery port for access to the interior of the receptacle when the sleeve is in the second position; a liner having a top opening for registering with the reception entrance, a bottom, and a longitudinal length between the opening and the bottom for extending axially within the interior of the receptacle to place the bottom adjacent the other of the ends; and attachment means for attaching the liner, adjacent the top opening thereof, to the receptacle for the reception of items axially into the liner, the attachment means being selectively releasable to enable removal of the liner, with the items therein, laterally through the registered delivery port and aperture when the sleeve is in the second position.

The invention will be more fully understood, while still further objects and advantages thereof will become apparent, by reference to the following detailed description of a preferred embodiment illustrated in the accompanying drawing, in which.

Figure 1:
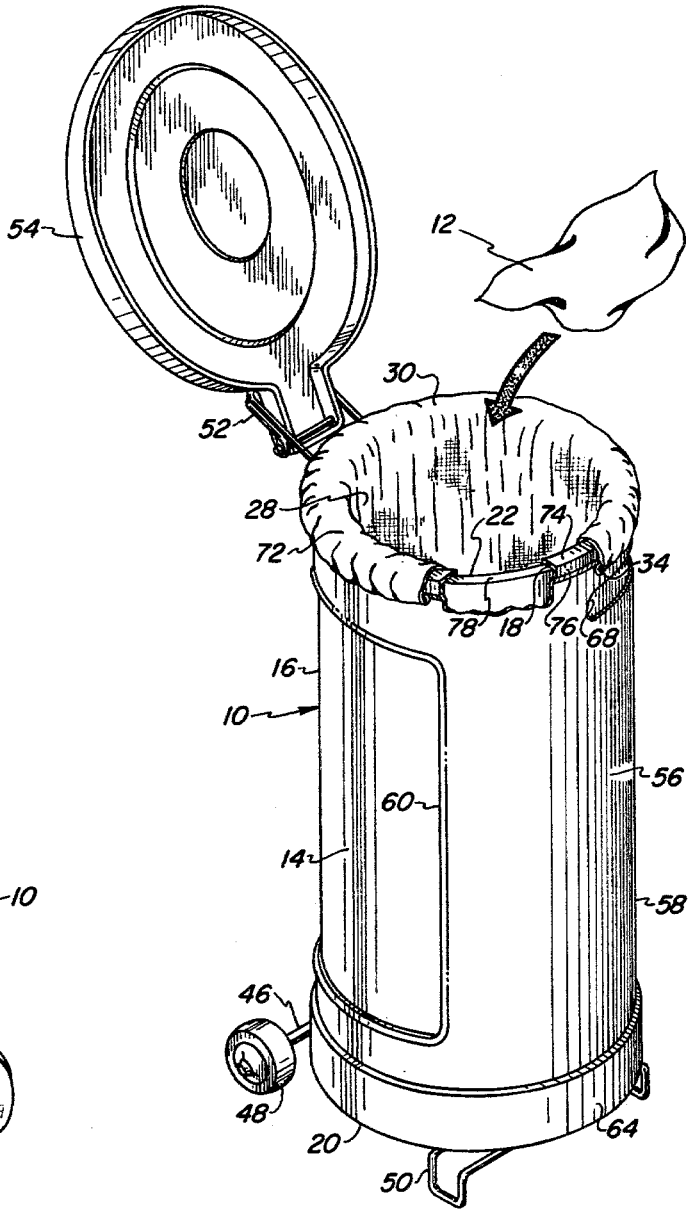
FIG. 1 is a perspective view of a hamper constructed in accordance with the invention.
Figure 2:
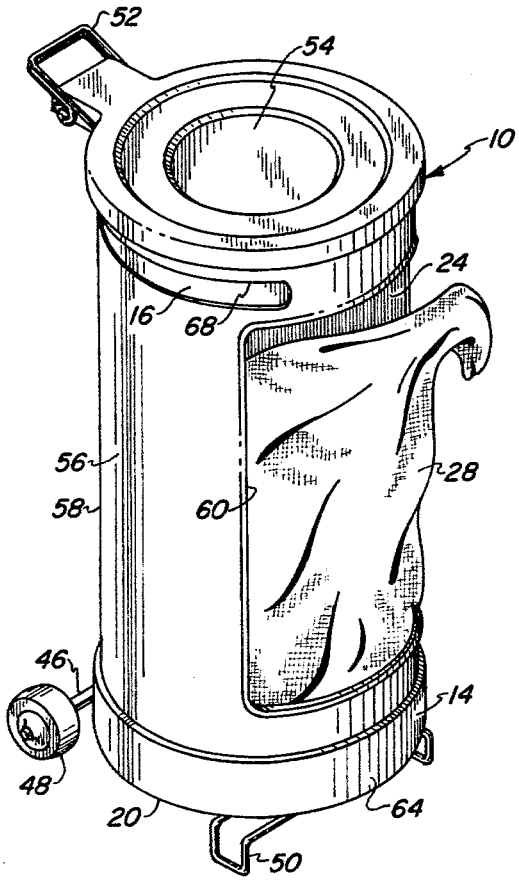
FIG. 2 is a perspective view similar to FIG. 1, but with the delivery port open.

Referring now to the drawing, and especially to FIGS. 1 and 2 thereof, a hamper 10 is shown constructed in accordance with the invention. Hamper 10 is a portable hamper used for collecting items, such as soiled laundry 12, placed in the hamper. Hamper 10 includes a receptacle 14 having a generally cylindrical tubular wall 16 extending axially between a top end 18 and opposite bottom end 20.

Figure 3:
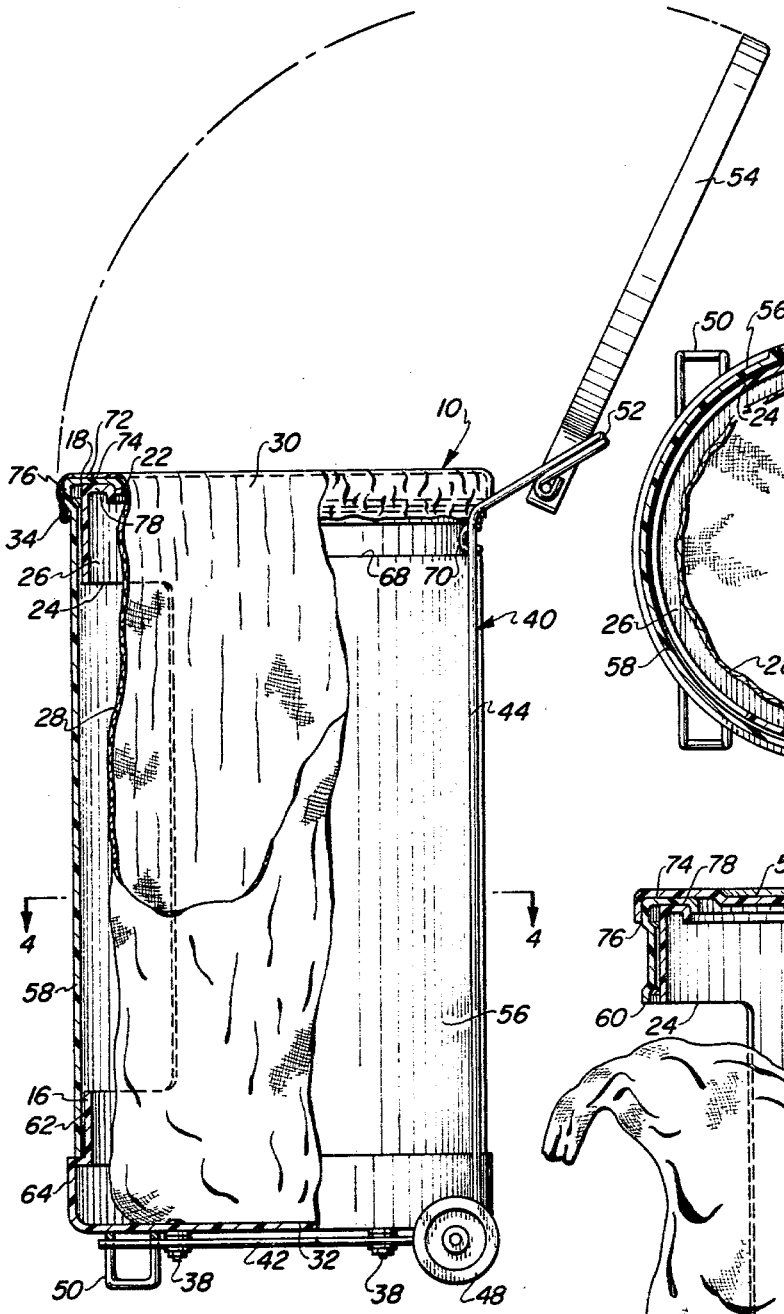
FIG. 3 is a side elevational view of the hamper of FIG. 1 partially construction.
Figure 4:
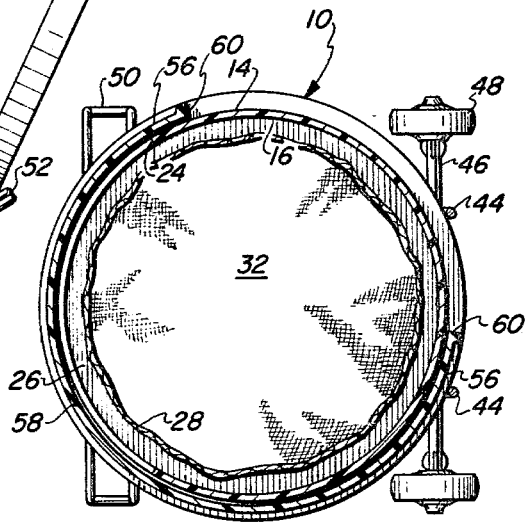
FIG. 4 is a cross-sectional view taken along line 4—4 of FIG. 3.
Figure 5:
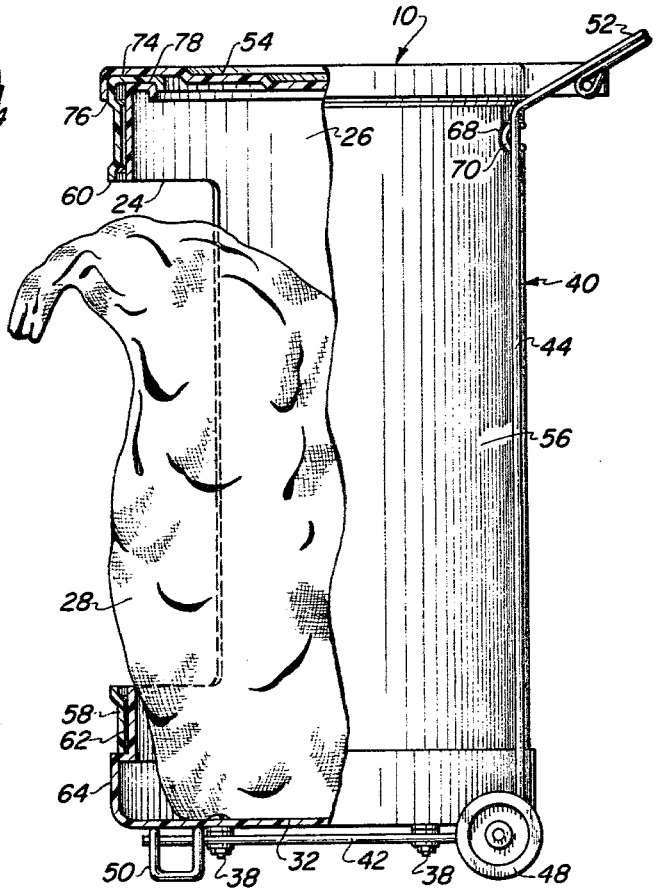
FIG. 5 is a side elevational view similar to FIG. 3, but with the delivery port open, as in FIG. 2.

Receptacle 14 includes a reception entrance 22 adjacent the top end 18 and a delivery port 24 in tubular wall 16, located between the top end 18 and the bottom end 20. As best seen in FIGS. 3, 4 and 5, as well as in FIGS. 1 and 2, reception entrance 22 and delivery port 24 each communicate with the interior 26 of the receptacle, and a liner, in the form of a laundry bag 28, is placed within the interior 26 of the receptacle. Bag 28 is constructed of a flexible fabric, such as woven nylon, and includes an opening 30 at the top thereof and a closed bottom 32. An elastic band 34 is sewn into bag 28 around the perimeter of the opening 30 and serves as an attachment means for attaching the bag 28 in place in the receptacle 14, in a manner which will be described more fully below.

Receptacle 14 is affixed to a frame 40 which includes a base 42 and upright rails 44. Nut and bolt assemblies 38 secure the bottom end 20 of receptacle 14 to the base 42 of frame 40. A carriage 46 having wheels 48 is attached to the frame 40 at a first portion thereof and a rest 50 is attached to the frame 40 at a second portion. A handle 52 is unitary with rails 44 at the upper extremity of the frame 40 and extends laterally outwardly beyond the carriage 46 in a direction opposite to the direction in which rest 50 is located. Thus, frame 40 can be grasped at handle 52, tilted about wheels 48 to raise the rest 50 and then wheeled about from location to location to collect and deliver items, such as soiled laundry 12. A cover 54 is mounted on frame 40, adjacent handle 52, for pivotal movement between an open position, as seen in FIGS. 1 and 3, wherein the handle 52 serves as a rest for the cover 54 and a closed position, as seen in FIGS. 2 and 4.

Delivery port 24 is selectively opened and closed by means of a cylindrical sleeve 56 mounted upon the receptacle 14 for rotation between a first position, as seen in FIG. 1, and a second position, as seen in FIG. 2. Sleeve 56 has a tubular wall 58 with an aperture 60 located between the ends of the wall 58 so that delivery port 24 is closed by wall 58 of sleeve 56 when the sleeve is in the first position, and is opened by the registration of aperture 60 with delivery port 24 when sleeve 56 is in the second position. Sleeve 56 is telescopically engaged over and overlies a recessed portion 62 of the exterior 64 of wall 16 of receptacle 14 and presents an uncluttered, aesthetically appealing appearance. A semi-annular slot 68 in the sleeve 56 receives a guide member 70 therein, the guide member 70 being integral with frame 40. The cooperation of guide member 70 with slot 68 confines the movement of sleeve 56 to rotation between the first and second positions, with the first and second positions being defined by the prescribed length of slot 68.

When the bag 28 is in place for the reception of soiled laundry 12, annular portion 72 of bag 28, adjacent the opening 30 at the top thereof, stretches over a radially-extending annular flange 74 of the sleeve 56 and the elastic band 34 is captured beneath an annular rib 76 which depends from flange 74 of the sleeve 56 to attach the bag in place. Soiled laundry 12 easily is placed in the bag 28 by merely opening cover 54 and axially dropping the soiled laundry 12 into the bag, as seen in FIG. 1.

When the bag 28 is full and is to be withdrawn from receptacle 14, sleeve 56 is rotated to the second position to open delivery port 24. Elastic band 34 is then released manually from rib 76 and collapses to close down the opening 30 at the top of bag 28. Since the full bag 28 is rather heavy, withdrawal of the bag 28 from receptacle 14 is simplified by merely pulling the full bag 28 laterally through delivery port 24, and registered aperture 60, rather than by lifting bag 28 axially upwardly through the entrance 22. Rotation of sleeve 56, even with a full bag 28 attached thereto, is facilitated by the engagement of the flange 74 of sleeve 56 with a radially-extending ledge 78 at the top end of the receptacle 14, adjacent the reception entrance 22. Flange 74 rests upon ledge 78 to support sleeve 56 for rotation on receptacle 14.

The simplified construction enables economy and ease of fabrication, as well as ease of use, and provides an attractive appearance. Both the receptacle 14 and sleeve 56, as well as cover 54, are readily fabricated of a molded synthetic resin, such as polyethylene. Frame 40 is a simple wire structure. Thus, hamper 10 is economical and attractive enough, as well as being flexible in its utility, to find application in a wide variety of uses.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A hamper for collecting items placed therein, said hamper comprising:

a receptacle having a generally cylindrical tubular wall extending axially between opposite ends, the receptacle including a reception entrance at one of said ends and a delivery port located in said wall between the ends, the reception entrance and the delivery port both communicating with the interior of the receptacle;

a cylindrical sleeve juxtaposed with the tubular wall of the receptacle and mounted upon the receptacle for rotation relative to the tubular wall between a first position, wherein the sleeve closes the delivery port, and a second position, said cylindrical sleeve including an aperture so located therein that the aperture is registered with the delivery port for access to the interior of the receptacle when the sleeve is in the second position;

a liner having a top opening for registering with the reception entrance, a bottom, and a longitudinal length between the opening and the bottom for extending axially within the interior of the receptacle to place the bottom adjacent the other of said ends; and attachment means for attaching the liner, adjacent the top opening thereof, to the receptacle for the reception of said items axially into the liner, said attachment means being selectively releasable to enable removal of the liner, with said items therein, laterally through the registered delivery port and aperture when the sleeve is in the second position.

2. The invention of claim 1 wherein the cylindrical sleeve overlies at least a portion of the exterior of the receptacle wall.

3. The invention of claim 2 wherein the portion of the exterior of the receptacle wall over which the cylindrical sleeve lies is recessed relative to further portions of the receptacle wall.

4. The invention of claim 1, 2 or 3 wherein the attachment means includes:

an annular rib extending radially outwardly adjacent the reception entrance of the receptacle about which annular rib there extends an annular portion of the liner adjacent the top opening thereof; and a retainer for retaining the annular portion of the liner in place about the annular rib.

5. The invention of claim 4 wherein the retainer includes elastic means for resiliently retaining the liner in place about the annular rib.

6. The invention of claim 4 wherein the annular rib is located upon the sleeve.

7. The invention of claim 6 wherein the sleeve is telescopically engaged over the receptacle wall, the receptacle wall including a radially-extending ledge adjacent the reception entrance and the sleeve having a radially-extending flange engaging the ledge such that the sleeve is supported for rotation on the receptacle wall by virtue of the engagement of the flange with the ledge.

8. The invention of claim 4 including:

a frame for supporting the receptacle; and a cover mounted upon the frame for pivotal movement between an open position away from the reception entrance and a closed position wherein the cover closes the reception entrance.

9. The invention of claim 1 including:

a frame for supporting the receptacle;

a semi-annular slot in the sleeve; and a guide member on the frame and engaged within the slot for guiding the sleeve during movement between the first and second positions thereof;

said slot having a prescribed length for defining the location of said first and second positions.

10. The invention of claim 9 wherein the cylindrical sleeve overlies at least a portion of the exterior of the receptacle wall.

11. The invention of claim 10 wherein the portion of the exterior of the receptacle wall over which the cylindrical sleeve lies is recessed relative to further portions of the receptacle wall.

12. The invention of claims 9, 10 or 11 wherein the attachment means includes:

an annular rib extending radially outwardly adjacent the reception entrance of the receptacle about which annular rib there extends an annular portion of the liner adjacent the top opening thereof; and a retainer for retaining the annular portion of the liner in place about the annular rib.

13. The invention of claim 12 wherein the retainer includes elastic means for resiliently retaining the liner in place about the annular rib.

14. The invention of claim 12 wherein the annular rib is located upon the sleeve.

15. The invention of claim 14 wherein the sleeve is telescopically engaged over the receptacle wall, the receptacle wall including a radially-extending ledge adjacent the reception entrance and the sleeve having a radially-extending flange engaging the ledge such that the sleeve is supported for rotation on the receptacle wall by virtue of the engagement of the flange with the ledge.

16. The invention of claim 12 including a cover mounted on the frame for pivotal movement between an open position away from the reception entrance and a closed position wherein the cover closes the reception entrance.

17. The invention of claim 16 including:

a handle on said frame; and a wheeled carriage on the frame for enabling selective wheeled movement of the hamper.

* * * * *